US009066603B2

(12) United States Patent
Mossbeck et al.

(10) Patent No.: US 9,066,603 B2
(45) Date of Patent: Jun. 30, 2015

(54) ADJUSTABLE BEDDING FOUNDATION AND PROCESS OF MAKING SAME

(75) Inventors: Niels S. Mossbeck, Carthage, MO (US); Ryan E. Chacon, Carthage, MO (US); Kelly M. Knewtson, Joplin, MO (US); Terrance L. Myers, Joplin, MO (US); Darrell A. Richmond, Carthage, MO (US); Daniel W. Williams, Webb City, MO (US)

(73) Assignee: L&P Property Management Company, South Gate, CA (US)

( * ) Notice: Subject to any disclaimer, the term of this patent is extended or adjusted under 35 U.S.C. 154(b) by 476 days.

(21) Appl. No.: 13/486,379

(22) Filed: Jun. 1, 2012

(65) Prior Publication Data

US 2013/0239324 A1 Sep. 19, 2013

Related U.S. Application Data

(60) Provisional application No. 61/612,568, filed on Mar. 19, 2012.

(51) Int. Cl.
*A47C 20/04* (2006.01)

(52) U.S. Cl.
CPC ..... *A47C 20/041* (2013.01); *Y10T 29/49826* (2015.01); *A47C 20/04* (2013.01)

(58) Field of Classification Search
CPC .... A47C 20/04; A47C 20/041; A47C 20/048; A47C 23/12; A47C 23/14; A47C 23/16; A47C 23/30; A61G 7/002; A61G 7/015; A61G 7/018
USPC ..... 5/613, 617, 633, 634, 412, 239, 244, 5/247, 255, 264.1, 657
See application file for complete search history.

(56) References Cited

U.S. PATENT DOCUMENTS

| | | | | |
|---|---|---|---|---|
| 1,332,546 | A * | 3/1920 | Dodds | 5/618 |
| 1,713,164 | A * | 5/1929 | Berry | 5/617 |
| 5,052,064 | A | 10/1991 | Hagemeister et al. | |
| 6,990,698 | B2 * | 1/2006 | Wall, Sr. | 5/618 |
| 7,036,166 | B2 * | 5/2006 | Kramer et al. | 5/618 |
| 7,398,568 | B1 | 7/2008 | Clark et al. | |
| 7,472,442 | B2 | 1/2009 | Mossbeck | |
| 7,610,638 | B2 | 11/2009 | Kramer et al. | |
| 7,805,780 | B2 | 10/2010 | Davis et al. | |
| 7,900,302 | B2 | 3/2011 | Long | |
| 7,930,777 | B2 | 4/2011 | Davis et al. | |
| 8,091,165 | B2 | 1/2012 | Mossbeck | |
| 2007/0157388 | A1 | 7/2007 | Mossbeck et al. | |
| 2007/0283501 | A1 | 12/2007 | Mossbeck | |
| 2009/0211028 | A1 | 8/2009 | Richmond et al. | |
| 2011/0314601 | A1 * | 12/2011 | Haffner et al. | 5/247 |

* cited by examiner

*Primary Examiner* — Nicholas Polito
(74) *Attorney, Agent, or Firm* — Wood, Herron & Evans, LLP

(57) ABSTRACT

A bedding foundation used to support a mattress has a mechanism therein for moving the mattress between inclined and flat positions. The foundation combines desirable features of conventional non-adjustable bed bases and adjustable bed bases. A wire assembly and a motorized lift assembly comprising a motorized drive mechanism may be secured to a base of the foundation. The motorized lift assembly pivots a lifter which has two curved portions which function to raise and lower a deck board to incline and lower the mattress. If desired, a second motorized lift assembly may be incorporated into a bedding foundation for use with another deck board.

29 Claims, 15 Drawing Sheets

ADJUSTABLE BEDDING FOUNDATION AND PROCESS OF MAKING SAME

CROSS REFERENCE TO RELATED APPLICATIONS

This application claims the benefit of U.S. provisional Patent Application Ser. No. 61/612,568 filed Mar. 19, 2012, entitled Modular Bed Base and Process of Making Same, which is fully incorporated by reference herein.

TECHNICAL FIELD

The present invention relates generally to bedding products and the methods for making such products.

BACKGROUND

In the bedding industry, bases or foundations for supporting mattresses fall into two categories: 1) stationary foundations, which do not have any moving parts, and, 2) adjustable bed bases which are usually motorized and may have moving parts for inclining a portion of a mattress resting on the adjustable bed base.

Commonly adjustable bed bases include one or more motors which actuate one or more drivers of the adjustable bed base to raise a portion of the bed base and mattress. In addition, such adjustable bed bases may include one or more vibratory motors which may impart vibrations to the mattress for a "massage" type effect or feel. Consequently, due to the hardware and electronics necessary to move a portion of an adjustable bed base, an adjustable bed base may be heavy and difficult to transport. Conventional stationary bedding foundations are commonly much lighter and easier to transport.

Existing adjustable bed bases are typically more expensive than conventional stationary bedding foundations because they have one or more motors or moving parts. Thus, a need exists in the art for a bedding foundation which combines desirable features of both adjustable bed bases and stationary bedding foundations.

SUMMARY OF THE INVENTION

According to one aspect of the invention, an adjustable bedding foundation comprises a lattice of support elements and a lift assembly wherein activation of the lift assembly moves a portion of the lift assembly through at least one opening in the lattice of support elements to adjust or move the foundation. The openings may be any desired shape or size. They need not be the same size or same shape.

According to another aspect of the invention, an adjustable bedding foundation comprises an assembly of support elements and a lift assembly wherein activation of the lift assembly moves a portion of the lift assembly through at least one opening in the assembly of support elements to adjust the foundation. Again, the openings may be any desired shape or size. They need not be the same size or same shape.

The lift assembly may be motorized and functions to move or pivot a lifter. The lifter may pivot about a horizontal axis and may have at least one curved portion which may contact a deck board to incline or decline the deck board. The deck board may be hinged to the lift assembly or to the support elements.

The support elements may include a base and a wire assembly secured to the base. The wire assembly may be a nestably stackable wire assembly comprising a plurality of support springs and an upper grid having a plurality of openings in the grid or lattice. The upper grid may include a rectangular border wire and a plurality of intersecting wires extending from one side of the border wire to the opposing side or one end of the border wire to the other end. The upper grid may be secured to the support springs. The base may comprise a rectangular frame and a plurality of transverse slats secured to the frame.

At least some of the support wires may have a plurality of flattened peaks secured to the upper grid and a plurality of flattened valleys secured to the base. The ends of at least some of the support wires may be secured to the border wire.

The motorized lift assembly may be activated by at least one remote control. In one embodiment, two remote controls are located on opposite sides of the bed so either remote control may raise or lower the head end of the adjustable foundation and mattress.

The support elements may include a base and an upper grid spaced above the base with a plurality of spacers. The upper grid may be considered a lattice having a plurality of openings. The openings may be different sizes and shapes; they need not be the same size or same shape.

The bedding foundation may be made by assembling a plurality of support elements. A lift assembly may be secured to some of the support elements. The lift assembly may be activated such that at least one curved portion of the lift assembly passes through at least one opening in the assembly of support elements to adjust the foundation.

The adjustable bedding foundation may be assembled in the following manner. A motorized lift assembly and a wire assembly may be secured to a base. The base, wire assembly and motorized lift assembly may be covered with a fabric covering. A deck board may be connected to the motorized lift assembly with at least one hinge, a portion of the at least one hinge passing through the fabric covering. Upon activation of the motorized lift assembly, a movable portion of the lift assembly may pass through at least one opening in the wire assembly, through the fabric covering and move the deck board to a desired position.

BRIEF DESCRIPTION OF THE DRAWINGS

The accompanying drawings, which are incorporated in and constitute a part of this specification, illustrate embodiments of the invention and, together with the general description given above and the detailed description of the embodiments given below, serve to explain the principles of the invention. In the figures, corresponding or like numbers or characters indicate corresponding or like structures.

DETAILED DESCRIPTION OF THE ILLUSTRATIVE EMBODIMENTS

Figure 1A:
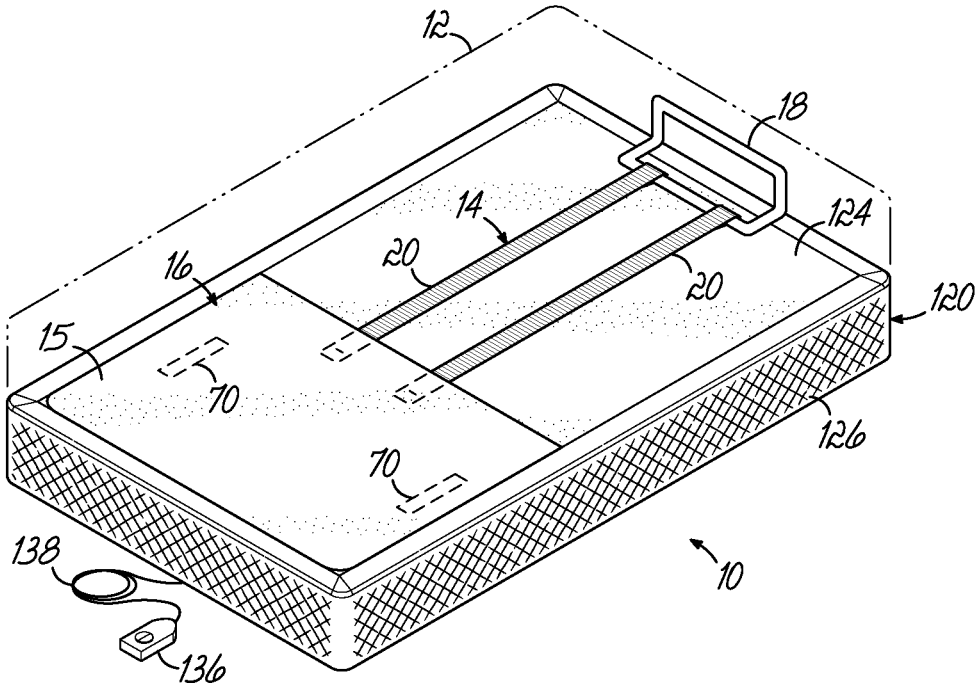
FIG. 1A is a perspective view of one embodiment of an adjustable bedding foundation, the foundation being shown in a lowered position.
Figure 1B:
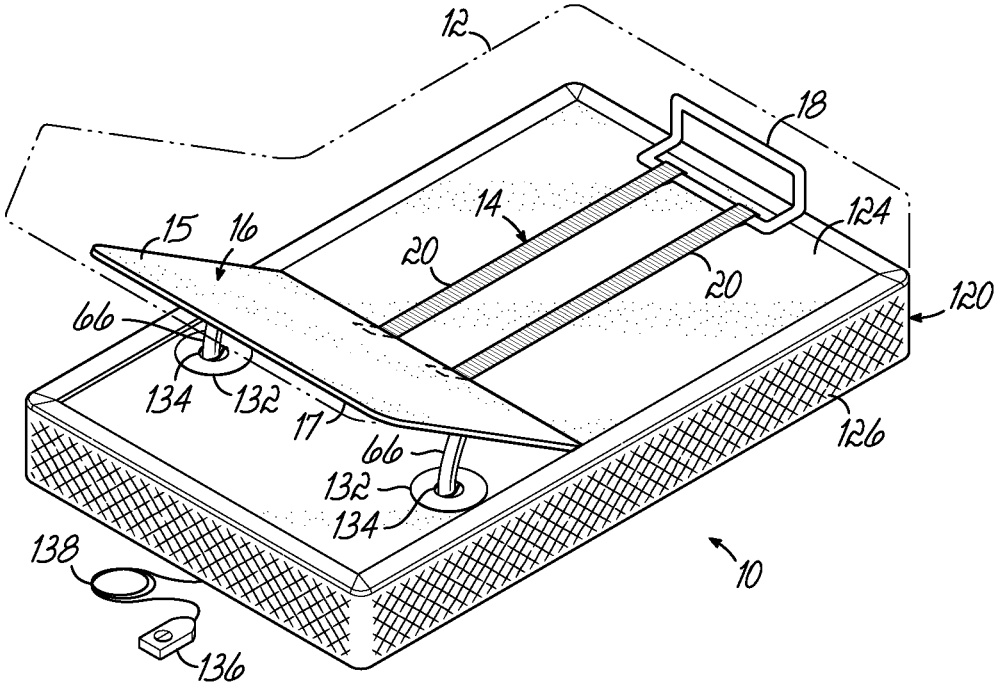
FIG. 1B is a perspective view of the adjustable bedding foundation of FIG. 1A, the foundation being shown in a raised position.

Referring to the figures, and particularly to FIGS. 1A and 1B, an adjustable bedding foundation is generally indicated by the numeral 10. The adjustable bedding foundation 10 is shown in FIG. 1A in a horizontal, flat or down position and is shown in FIG. 1B in a raised or inclined position. A mattress 12 is shown in dashed lines on top of the adjustable bedding foundation 10.

The present invention is not intended to limit the mattress 12 used with the adjustable bedding foundation 10. The mattress 12 may be a conventional mattress having coil springs, a foam mattress or any type of mattress.

As shown in FIGS. 1A and 1B, the adjustable bedding foundation 10 may include a mattress stop 14 for preventing the mattress 12 from moving towards the foot end of the bed when the adjustable foundation 10 is raised or inclined. The adjustable bedding foundation 10 further comprises a deck board 16 made of plywood or any suitable material. The deck board 16 may be partially covered with a cover 15 (see FIGS. 4A and 4B).

Referring to FIGS. 1A, 1B, 3 and 3E, mattress stop 14 comprises a stopping bracket 18 and two straps 20. Each strap 20 is secured to the stopping bracket 18 and the deck board 16 and extends therebetween. More particularly, the ends of straps 20 are secured to a lower surface or underside 17 of the deck board 16 with staples or any other conventional fasteners (not shown). Although one type of mattress stopping bracket 18 is shown, other types or configurations of stopping brackets made of metal, plastic or any known materials may be used to prevent the mattress 12 from moving towards the foot end of the bed when the deck board 16 is raised or inclined as shown in FIG. 1B from its horizontal position shown in FIG. 1A. Although two straps 20 are shown connecting the deck board 16 and mattress stopping bracket 18, any number of straps, including only one, may used.

Figure 3:
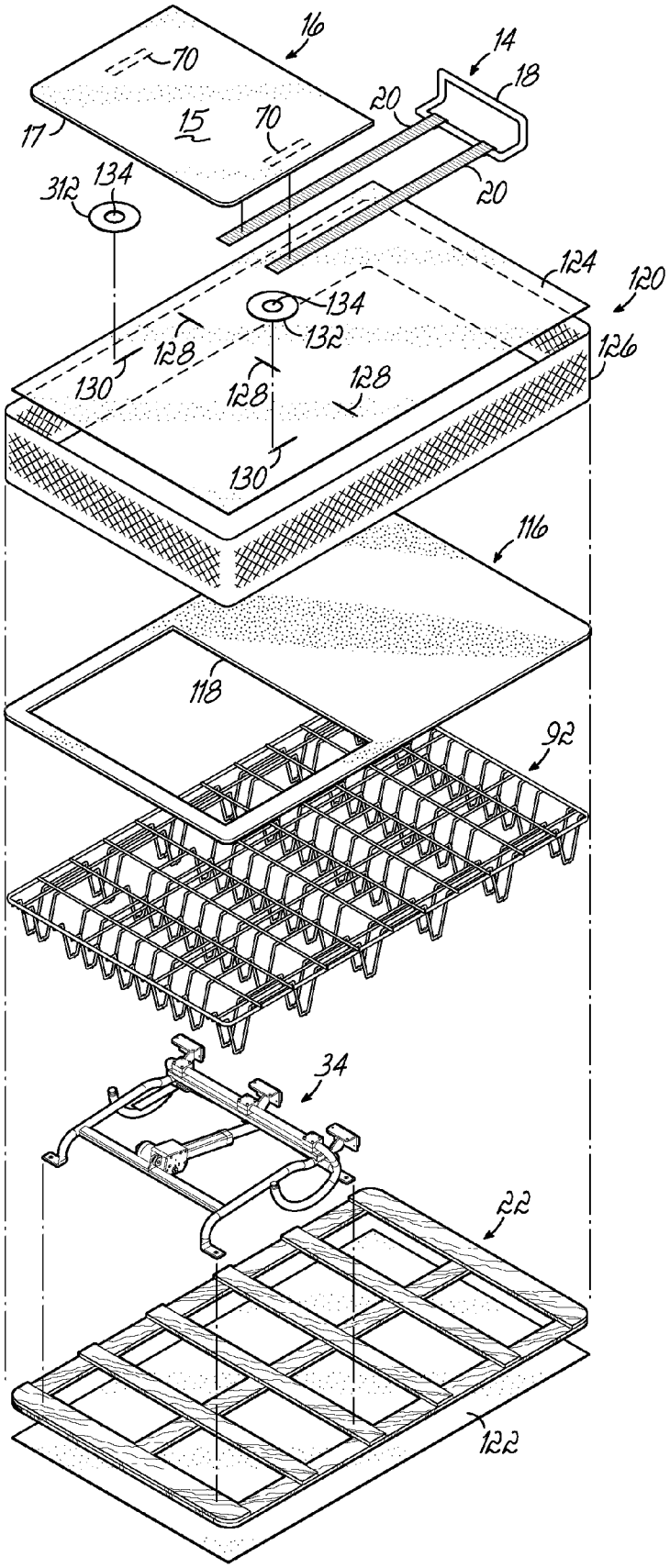
FIG. 3 is a partially disassembled perspective view of the adjustable bedding foundation of FIG. 1A.
Figure 3A:
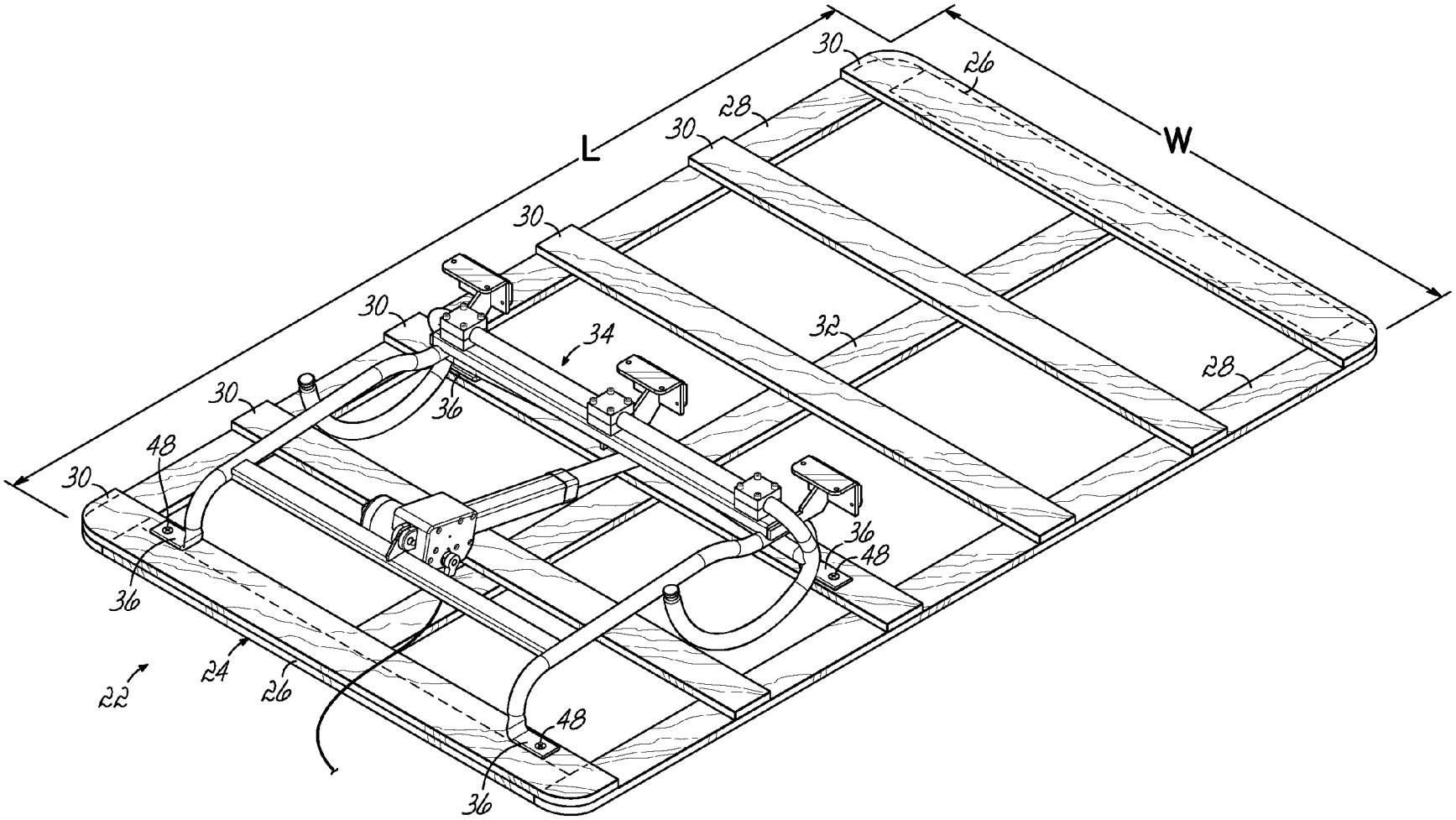
FIG. 3A is a perspective view of the lift assembly of FIG. 2 secured to a base of the adjustable bedding foundation of FIG. 1A.

FIG. 3 illustrates additional components of the adjustable bedding foundation 10. FIG. 3 illustrates a base 22, which is commonly made of wood, but may be made of plastic or any other material. As shown in FIG. 3A, base 22 may include a generally rectangular frame 24 having two opposed ends 26 and two opposed sides 28. The distance between the frame end members 26 defines the length "L" of the foundation 10, and the distance between the frame side members 28 defines the width "W" of the foundation 10. Although the length or longitudinal dimension is shown as being greater than the width or transverse dimension, the length and width may be identical in a square foundation. A plurality of spaced slats 30 extend between the frame side members 16. A longitudinal middle member 32 extends between the frame end members 26.

Figure 2:
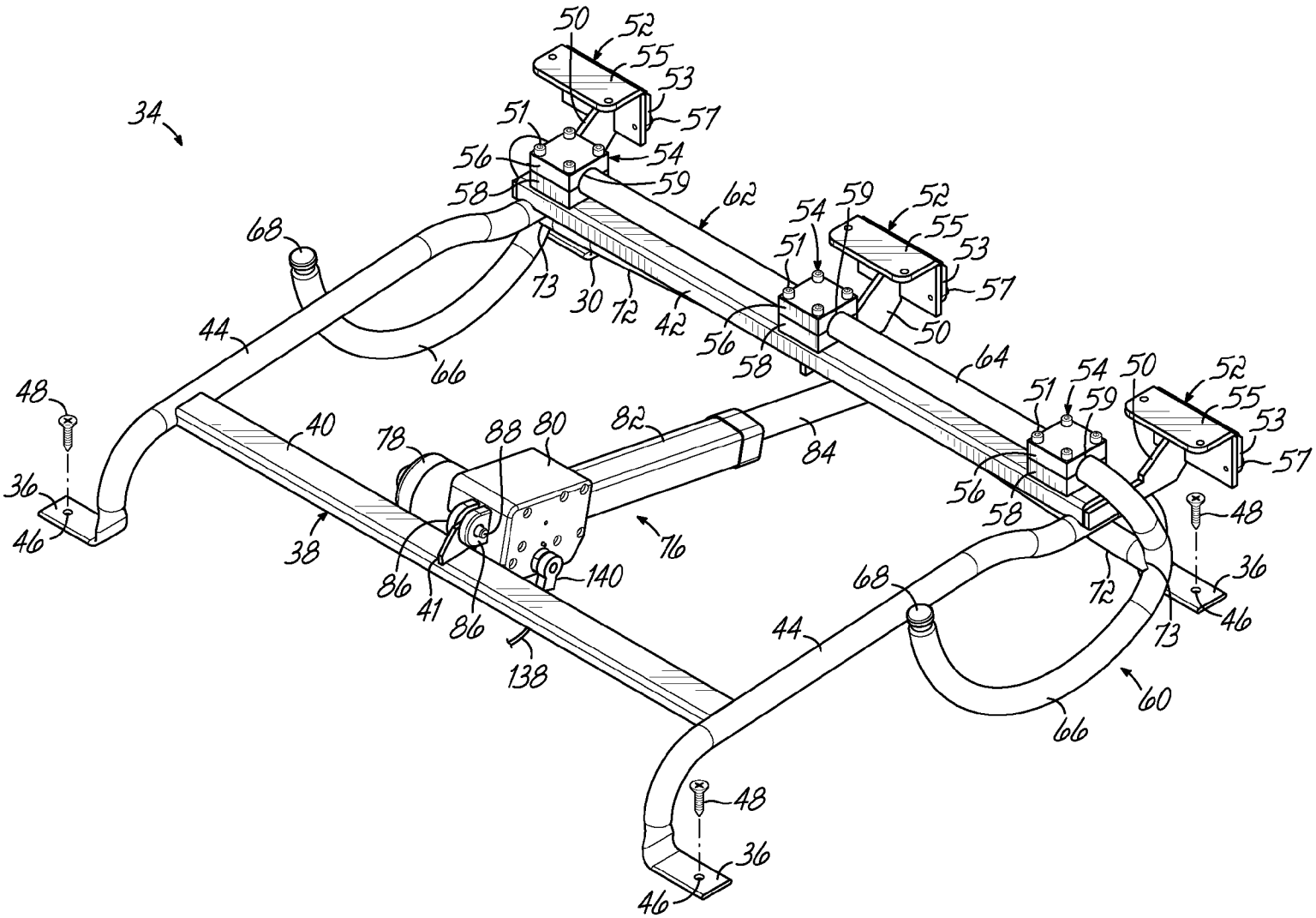
FIG. 2 is a perspective view of the lift assembly of the adjustable bedding foundation of FIG. 1A.

As best shown in FIG. 2, the adjustable bedding foundation 10 further comprises a motorized lift assembly 34. As best shown in FIG. 3A, the motorized lift assembly 34 is secured to the base 22. More specifically, four feet 36 of the motorized lift assembly 34 are secured to two of the slats 30 of the base 22 (one being an end most slat 30).

As best shown in FIG. 2, the motorized lift assembly 34 comprises a rectangular stationary frame 38 comprising an actuator mount tube 40, a mount arm 42 parallel the actuator mount tube 40 and two parallel tube support arches 44 welded or joined together. Each tube support arch 44 terminates at each end with a foot 36. Each foot 36 has hole 46 therethrough for receiving a fastener 48. The fasteners 48 pass through the holes 46 of the feet 36 and into the slats 30 of the base 22, as shown in FIG. 3A.

Figure 2A:
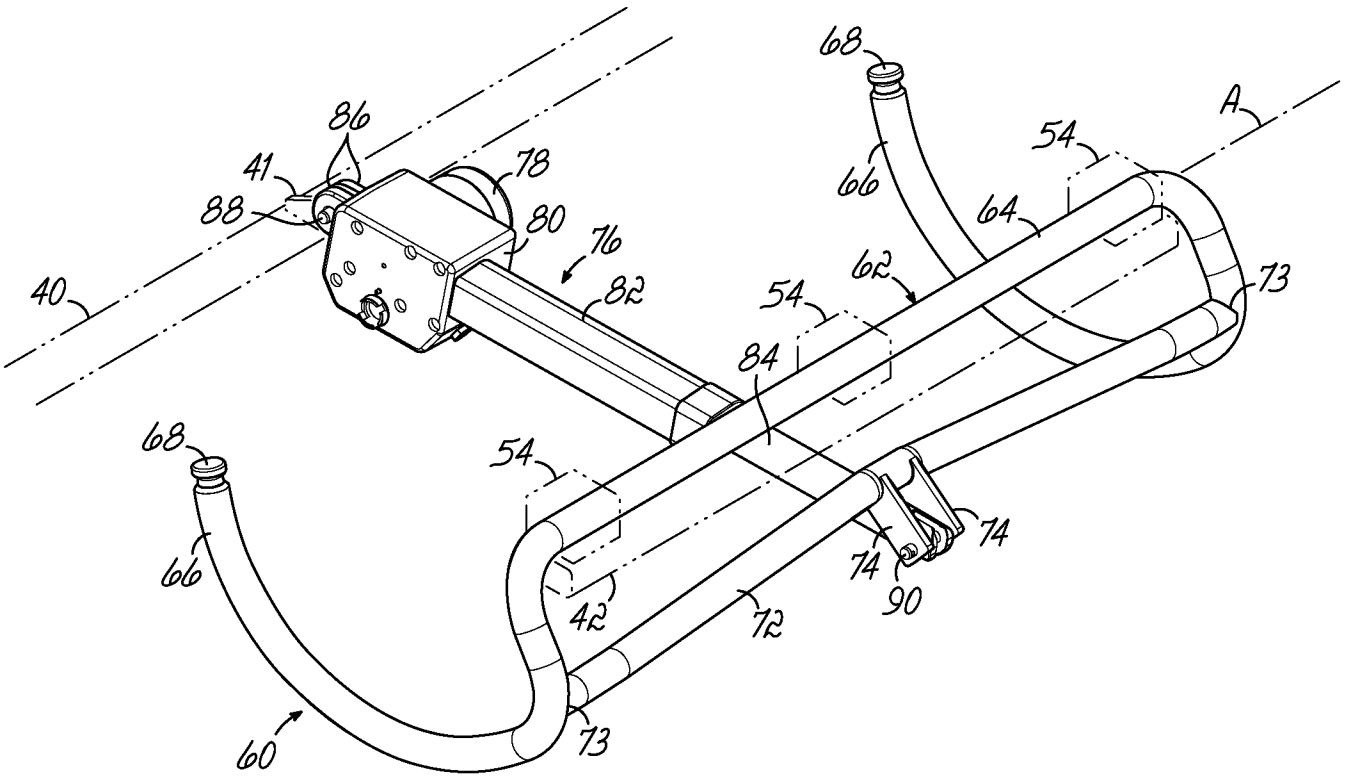
FIG. 2A is a perspective view of a portion of the lift assembly of FIG. 2.

As best shown in FIGS. 2 and 2A, a mounting tab 41 is welded or otherwise secured to the actuator mount tube 40 of the stationary frame 38. As shown in FIG. 2, three hinge mounts 50 are welded or otherwise secured at three spaced locations to the stationary mount arm 42 of the stationary frame 38 of the motorized lift assembly 34. Each hinge mount 50 is stationary and functions to provide a location for a hinge 52 to be mounted. Although three hinge mounts 50 are illustrated and described, the adjustable bedding foundation 10 may have any number of hinge mounts 50 and corresponding hinges 52 (including only one hinge) without departing from the spirit of the invention. The details of each hinge 52 are described below.

As best shown in FIG. 2, the motorized lift assembly 34 further comprises three stationary or fixed mounting members 54 spaced from each other. Each mounting member 54 is secured to the stationary mount arm 42 of the stationary frame 38 of the motorized lift assembly 34, like the hinge mounts 50. Four fasteners 51 pass through an upper half 56 of each mounting member 54 and into a lower half 58 of the mounting member 54. When secured together, the upper and lower halves 56, 58 of each mounting member 54 has a passage 59 through it adapted to receive a pivotal or movable lifter 60. The lifter 60 functions to raise or incline the deck board 16 in a manner described below.

As best shown in FIG. 2A, lifter 60 comprises a tube lift arm 62 having a straight portion 64 and two curved end portions or tusks 66. The straight portion 64 passes through the passages 59 of each of the three mounting members 54 and defines a pivot axis A. At the end of each tusk 66 may be a contact member 68 which may be covered with felt and is adapted to contact a slider strip 70 on the underside 17 of deck board 16. As best shown in FIG. 3E, two slider strips 70 are secured to the underside 17 of deck board 16. As best shown in FIG. 4B, each contact member 68 contacts one of the two slider strips 70 secured to the underside 17 of deck board 16 and slides along the slider strip 70 as the lifter 60 and deck board 16 move.

As best shown in FIG. 2A, the lifter 60 further comprises a pull arm 72 welded at opposite ends 73 to the tube lift arm 62. The pull arm 72 has two tabs 74 welded to it for securing one end of a motorized actuator 76 to the lifter 60. As the movable piston 84 of the motorized actuator 76 moves, the lifter 60 pivots as a whole about pivot axis A, the three mounting members 54 functioning to hold the straight portion 64 of lifter 60 in place, but allow the lifter 60 to pivot.

As best shown in FIGS. 2 and 2A, the motorized actuator 76 comprises a motor 78, a control box 80, a cylinder 82 and a movable piston 84. The motorized actuator 76 further comprises two tabs 86 for securing the motorized actuator 76 to the mounting tab 41 welded to the mount tube 40 of the stationary frame 38 of the motorized lift assembly 34 with a holder or pin 88. Upon activation of the motor 78, the control box 80 moves the piston 84 between an extended position shown in FIG. 4A and a contracted position shown in FIG. 4B. When the piston 84 is in its extended position shown in FIG. 4A, the pull arm 72 of lifter 60 is located generally behind the stationary mount arm 42 of the stationary frame 38. On the other hand, when the piston 84 is in its retracted position shown in FIG. 4B, the pull arm 72 of lifter 60 is located generally in front of the stationary mount arm 42 of the stationary frame 38. As shown in FIG. 2A, the end of the piston 84 has a hole therethrough and is held in place between tabs 74 of the pull arm 72 of the lifter 60 with a holder or pin 90.

As shown in FIG. 2, each hinge 52 may be made of plastic or metal or other suitable material and comprises two portions, a first portion 53 and a second portion 55 joined together. In one embodiment, they are joined by a living hinge and are made of plastic. As best shown in FIGS. 4A and 4B, the first or vertical portion 53 of each hinge 52 is attached with fasteners 57 to one of the hinge mounts 50. The second portion 55 is shown horizontally oriented in FIG. 2 and vertically oriented in FIG. 3D. This second portion 55 of each hinge 52 is the portion which is attached in any conventional manner to the underside or lower surface of the deck board 16.

FIG. 3 shows another component of the adjustable bedding foundation 10, a nestable, stackable wire assembly 92, like the one disclosed in U.S. Pat. No. 5,052,064, which is fully incorporated by reference herein. Different wire assemblies may be used in accordance with the present invention including, but not limited to, the wire assemblies disclosed in U.S. Pat. Nos. 7,805,780 and 7,930,777, each one of which is fully incorporated by reference herein.

Figure 3B:
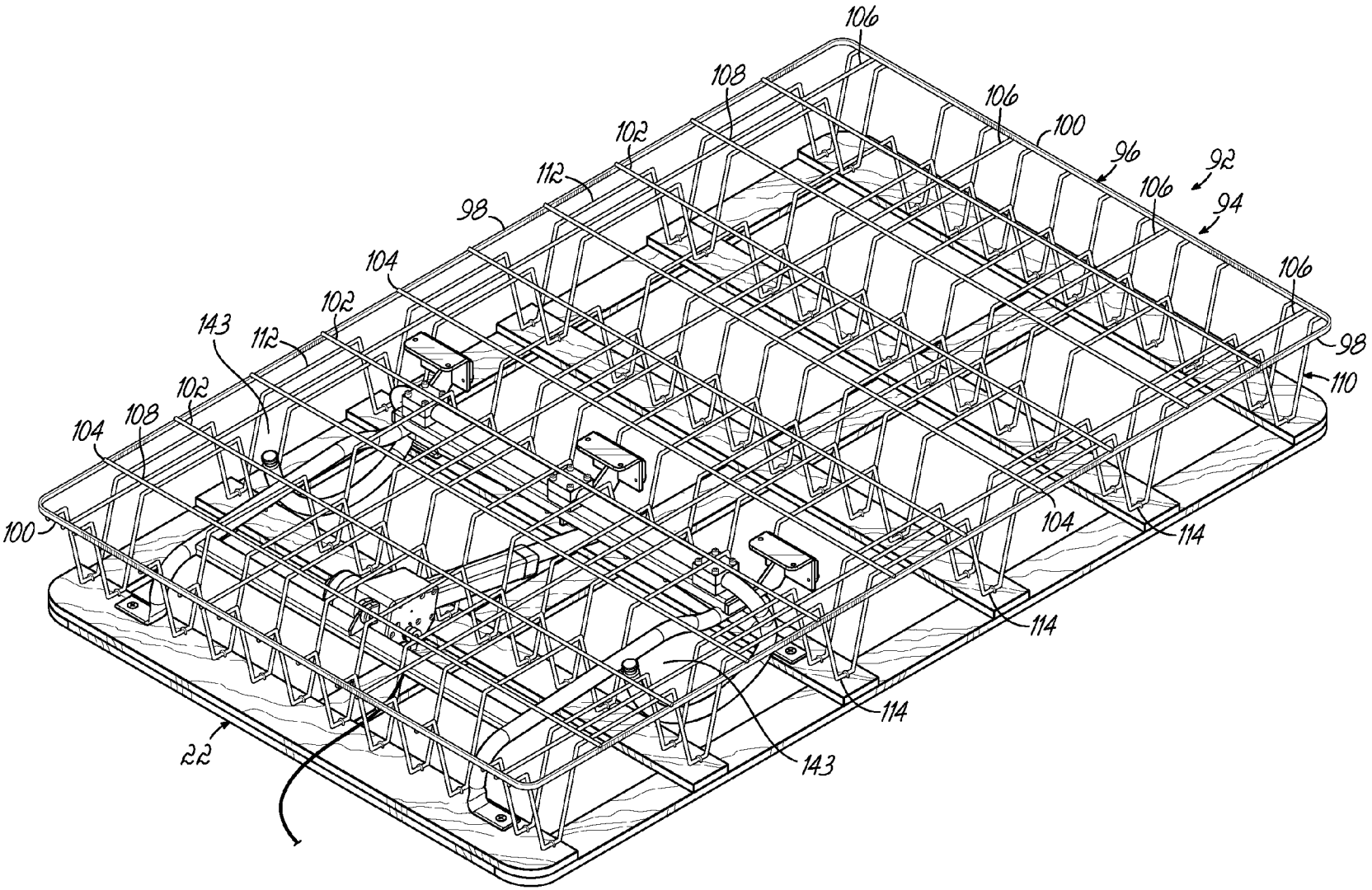
FIG. 3B is a perspective view of the lift assembly of FIG. 2 and a wire assembly secured to a base of the adjustable bedding foundation of FIG. 1A.

As best shown in FIG. 3B, the nestable, stackable wire assembly 92 comprises an upper grid 94, including a rectangular border wire 96 having two parallel sides 98 and two parallel ends 100. The upper grid 94 further comprises a plurality of longitudinally spaced, parallel and transversely extending upper connector wires 102 parallel to the border wire ends 100 and having ends 104 connected to the border wire sides 98. The upper grid 94 may further comprise a plurality of longitudinally extending support wires 106 extending between and connected to the border wire ends 100 and being welded to the upper connector wires 102 at intersections 108.

The nestable, stackable wire assembly 92 further comprises a plurality of generally corrugated support wires 110, each support wire 110 having a plurality of flattened peaks 112 secured to the upper grid 94 and a plurality of flattened valleys 114 secured to the base 22. More specifically, the flattened peaks 112 are welded to the upper connector wires 102 of the upper grid 94, and the flattened valleys 114 are stapled to the slats 30 of the base 22.

Figure 3C:
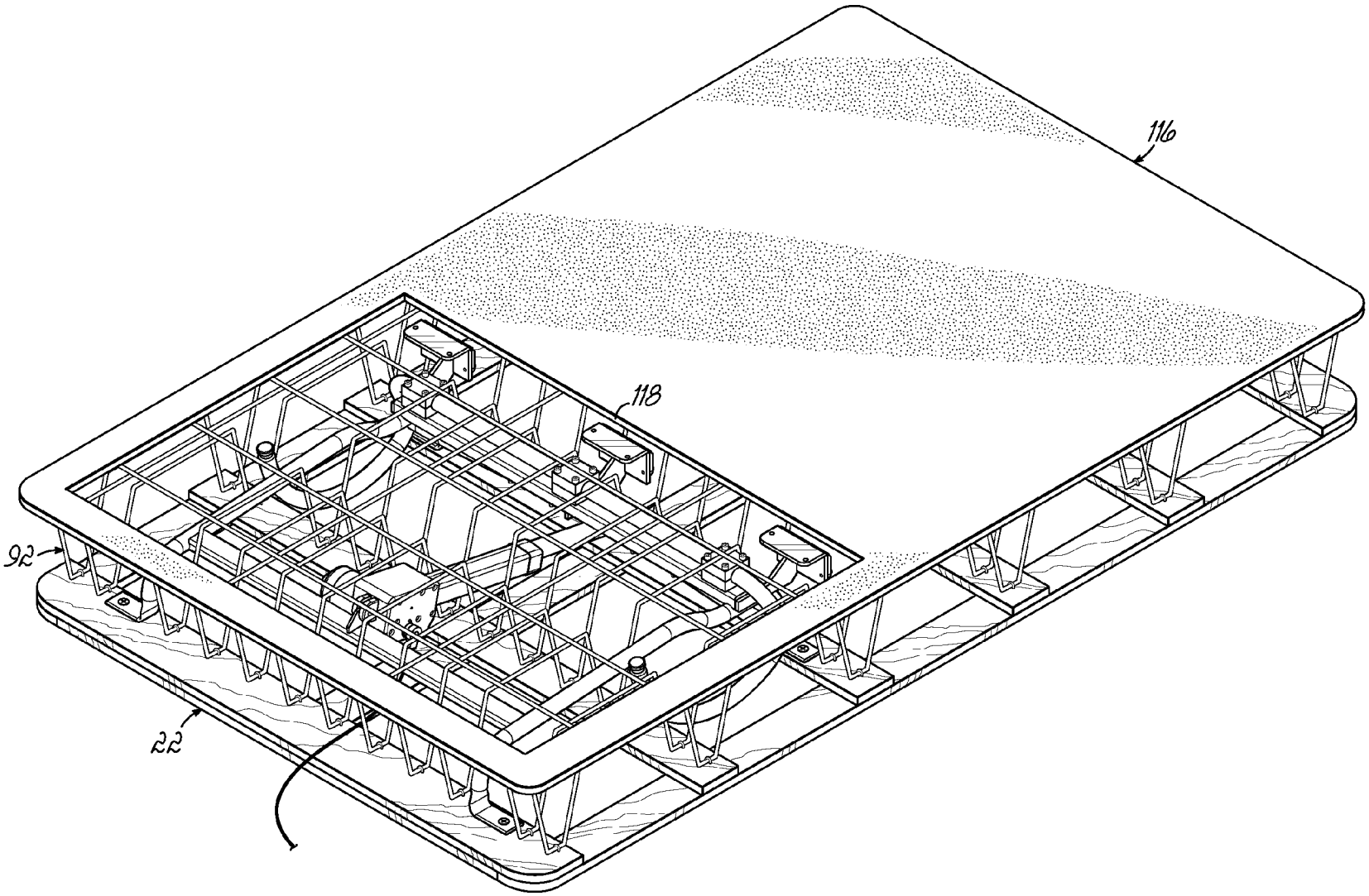
FIG. 3C is a perspective view of the partial assembly of FIG. 3B showing a fiber pad on top of the wire assembly of the partial assembly of FIG. 3B.

As shown in FIGS. 3 and 3C, a fiber pad 116 partially covers an upper surface of the wire assembly 92. The fiber pad 116 has a rectangular cutout 118 approximately the same size as the deck board 16 so that when the deck board 16 is horizontal in its flat position, it may fit inside the cutout 118 of the fiber pad 116, thereby creating an even top surface for the foundation 10, as shown in FIG. 3E. The pad 116 is not intended to be limited to fiber; it may be made of foam, a foam/fiber mix or any other desirable material.

Figure 3D:
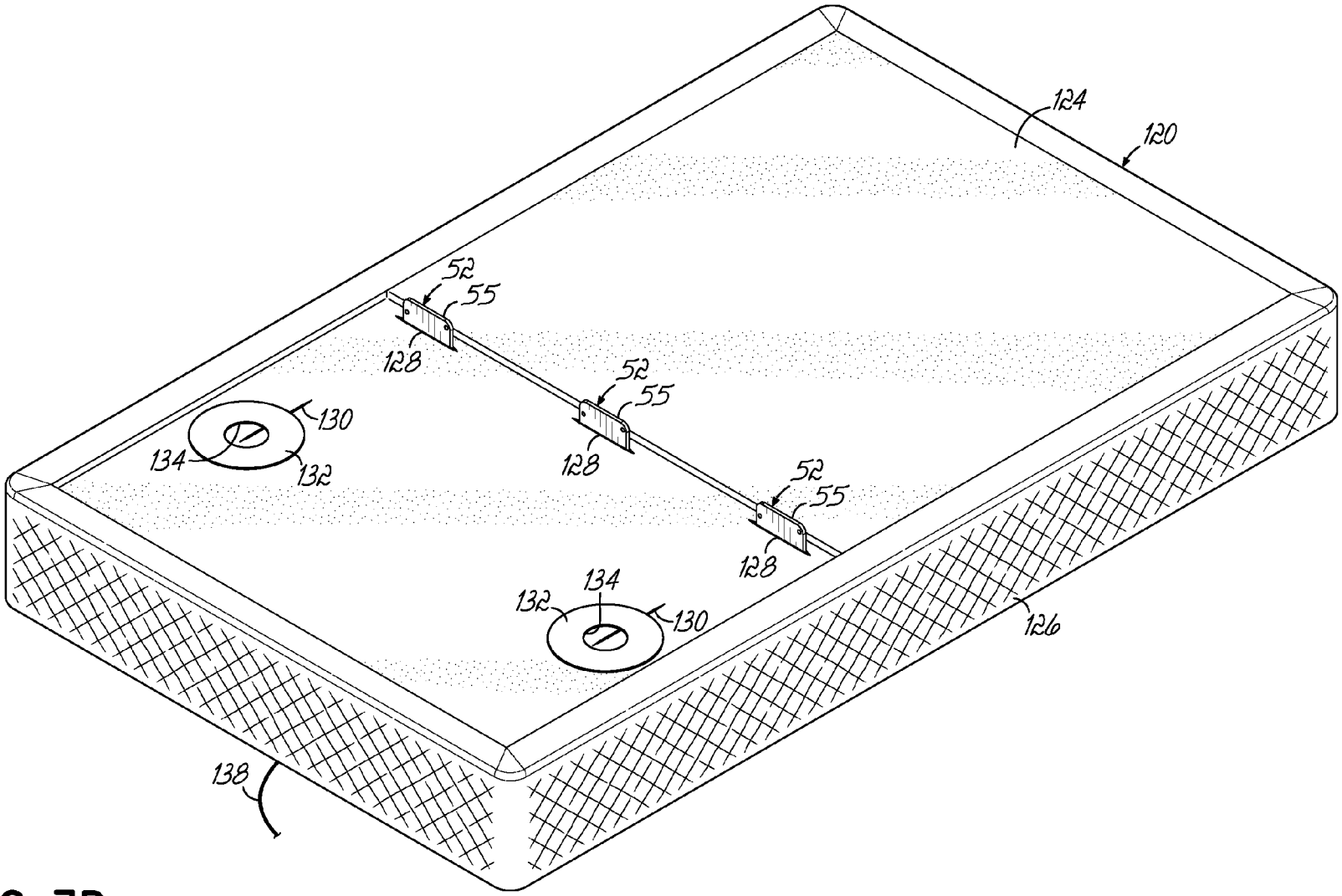
FIG. 3D is a perspective view of partial assembly of the adjustable bedding foundation of FIG. 1A.
Figure 3E:
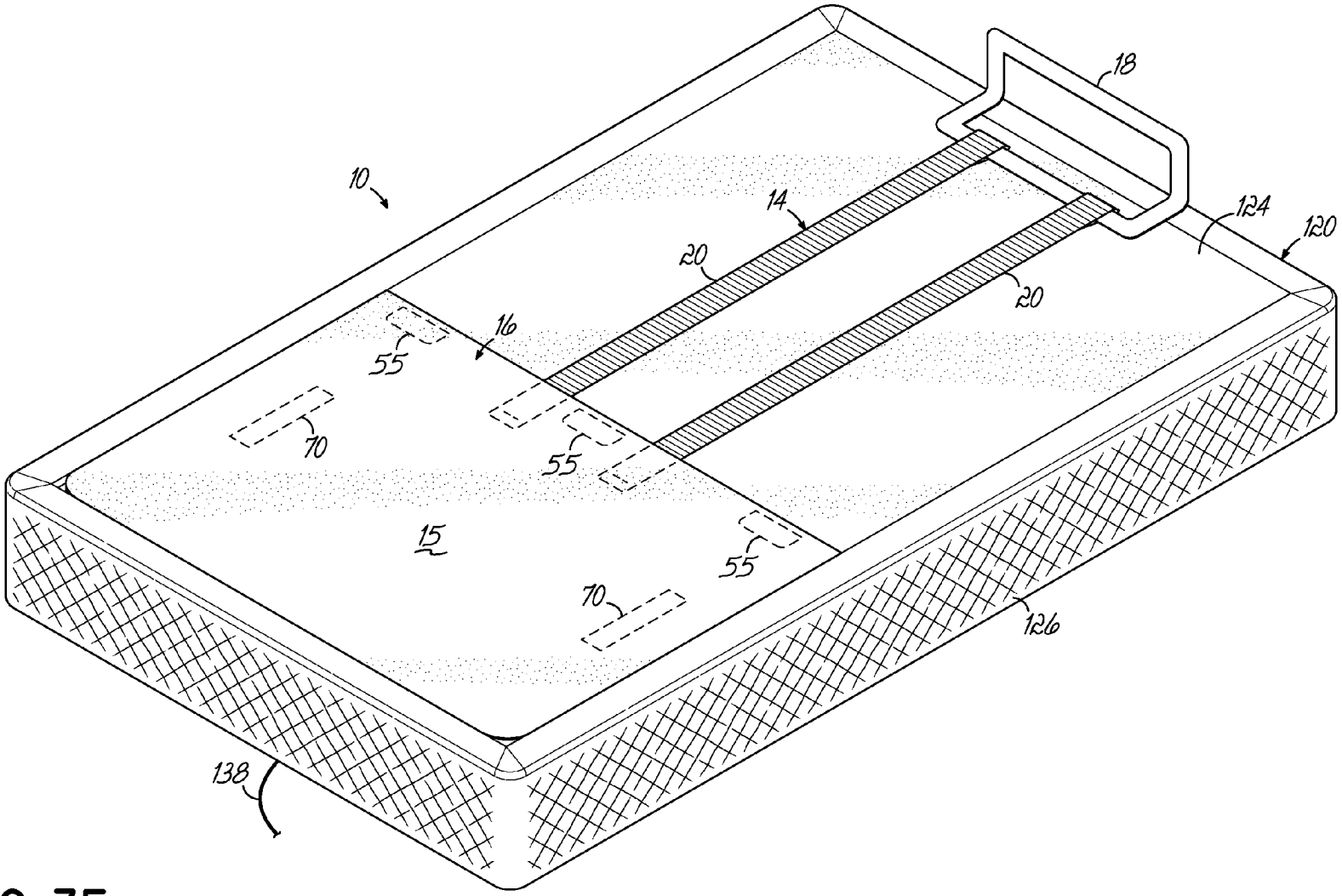
FIG. 3E is a perspective view of a portion of the adjustable bedding foundation of FIG. 1A.
Figure 4A:
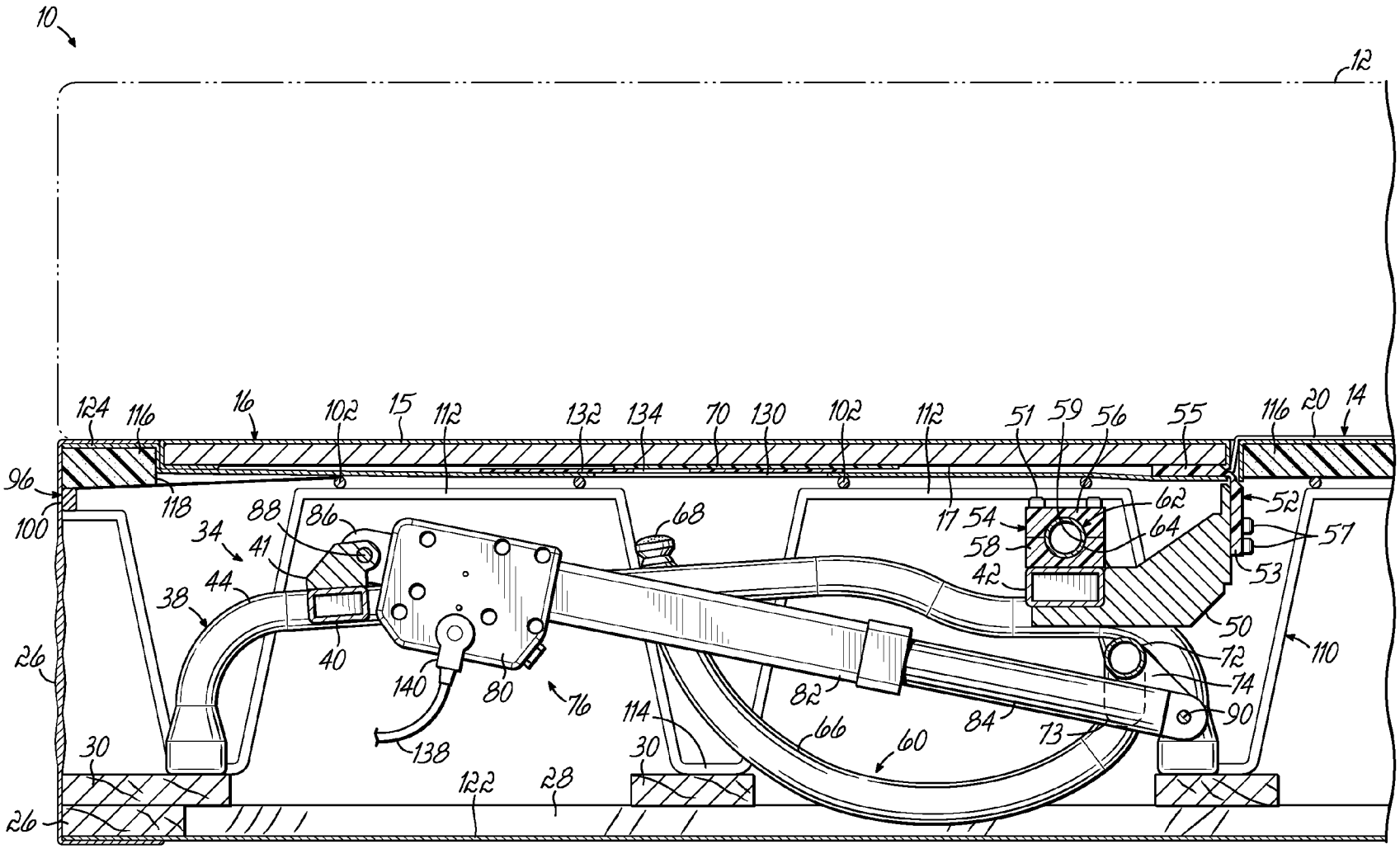
FIG. 4A is an enlarged cross sectional view of a portion of the adjustable bedding foundation of FIG. 1A, the deck board being shown in a horizontal position.
Figure 4B:
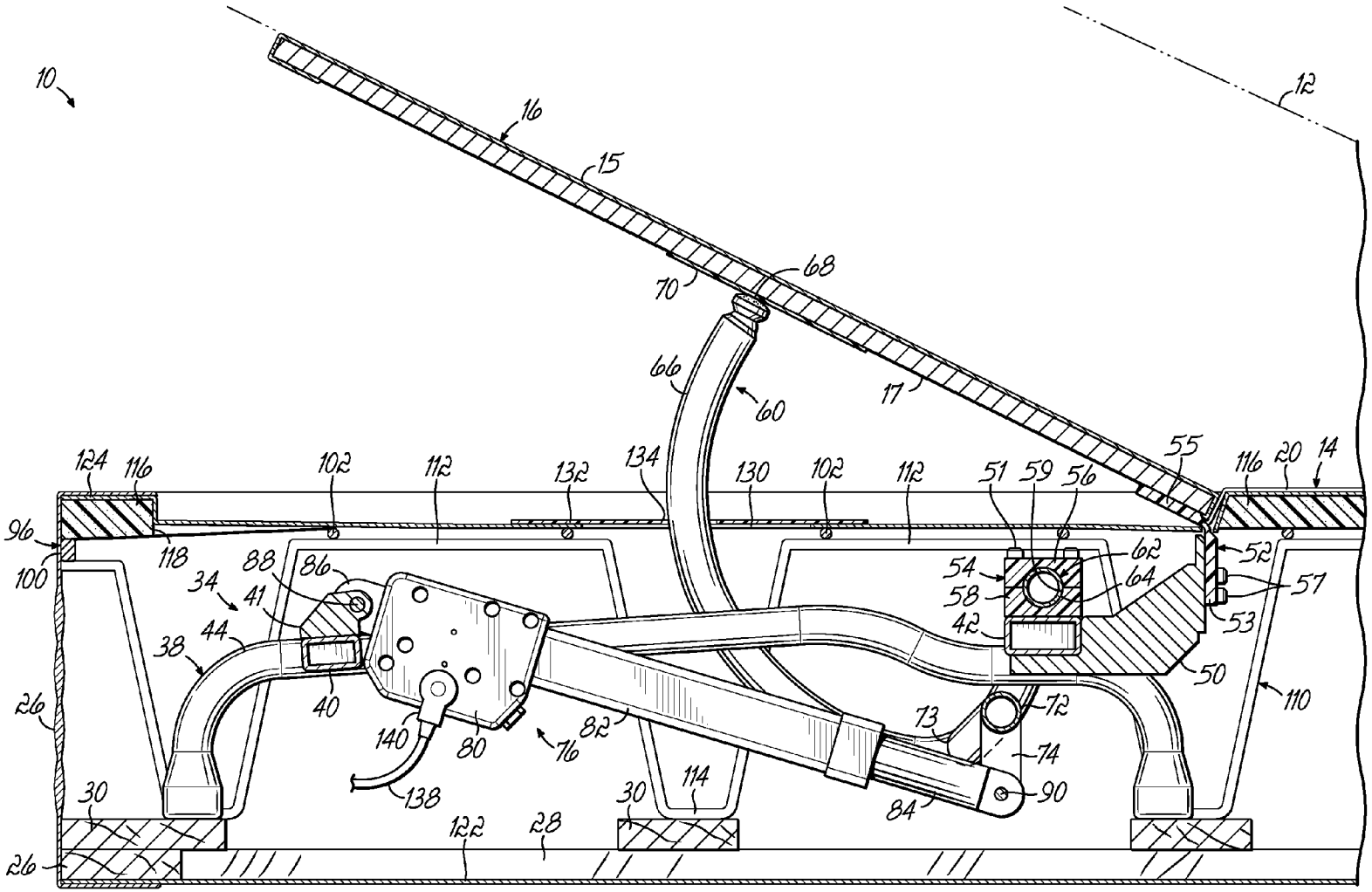
FIG. 4B is an enlarged cross sectional view of a portion of the adjustable bedding foundation of FIG. 1A, the deck board being shown in an inclined position.

The base 22, the motorized lift assembly 34 and wire assembly 92, each being secured to the base 22, and the fiber pad 116 are surrounded with a covering 120, best shown in FIGS. 3D and 3E. As shown in FIG. 3, covering 120 comprises a lower or bottom panel 122, an upper or top panel 124 and a border 126 sewn or otherwise combined together to form the covering 120.

As best illustrated in FIG. 3D, the top panel 124 of covering 120 has three spaced slits 128 through which portions 55 of the hinges 52 pass in order to attach the deck board 16 to the hinges 52. Also illustrated in FIG. 3D are two additional slits 130 cut in the top panel 124 of covering 120. These slits 130 allow the tusks 66 of the lifter 60 to pass through the top panel 124 of covering 120 and raise the deck board 16, as shown in FIG. 4B. Outside the top panel 124 of covering 120, a ring 132 is located above each slit 130. Each ring 132 has a central opening 134 through which one of the tusks 66 of the lifter 60 passes. As the tusks 66 of lifter 60 move, each ring 132 moves with the tusks 66 outside the covering 120, as shown in FIG. 3D.

As shown in FIGS. 1A and 1B, the motorized actuator 76 has a remote control 136 connected with a wire 138 to the control box 80 of the motorized actuator 76. FIGS. 4A and 4B show the wire 138 having an end 140 connected to the control box 80. Any type of remote control, including a wireless remote control, may be used to activate the motorized actuator 76 to raise or lower the deck board 16 in order to raise or lower a head end of the mattress 12.

In operation, when the motorized linear actuator 76 is actuated, the piston 84 is pulled into the cylinder 82, causing the lifter 60 to pivot about axis A, thereby moving the tusks or curved portions 66 of the lifter 60 to pass through openings 142 in the upper grid 94 of the wire assembly 92. This movement continues with the contact members 68 of the lifter 60 contacting and raising the deck board 16 to a raised position shown in FIG. 4B. Likewise, when the motorized linear actuator 76 is actuated, the piston 84 is pushed out of the cylinder 82, causing the lifter 60 to pivot about axis A in the opposite direction, thereby moving the tusks or curved portions 66 of the lifter 60 to move downwardly through the same openings 142 in the upper grid 94 of the wire assembly 92. This movement continues when the deck board 16 is lowered to a horizontal position shown in FIG. 4A.

In combination, the base 22 and wire assembly 92 may be considered an assembly of support elements having at least one opening through which the curved portions of lifter 60 may pass to raise and lower the deck board 16. The upper grid 94 of the wire assembly 92 may be considered a lattice having openings 143, as shown in FIG. 3B. The openings 143 of the upper grid or lattice 94 may be different sizes and shapes; they need not be the same size or shape.

Figure 5:
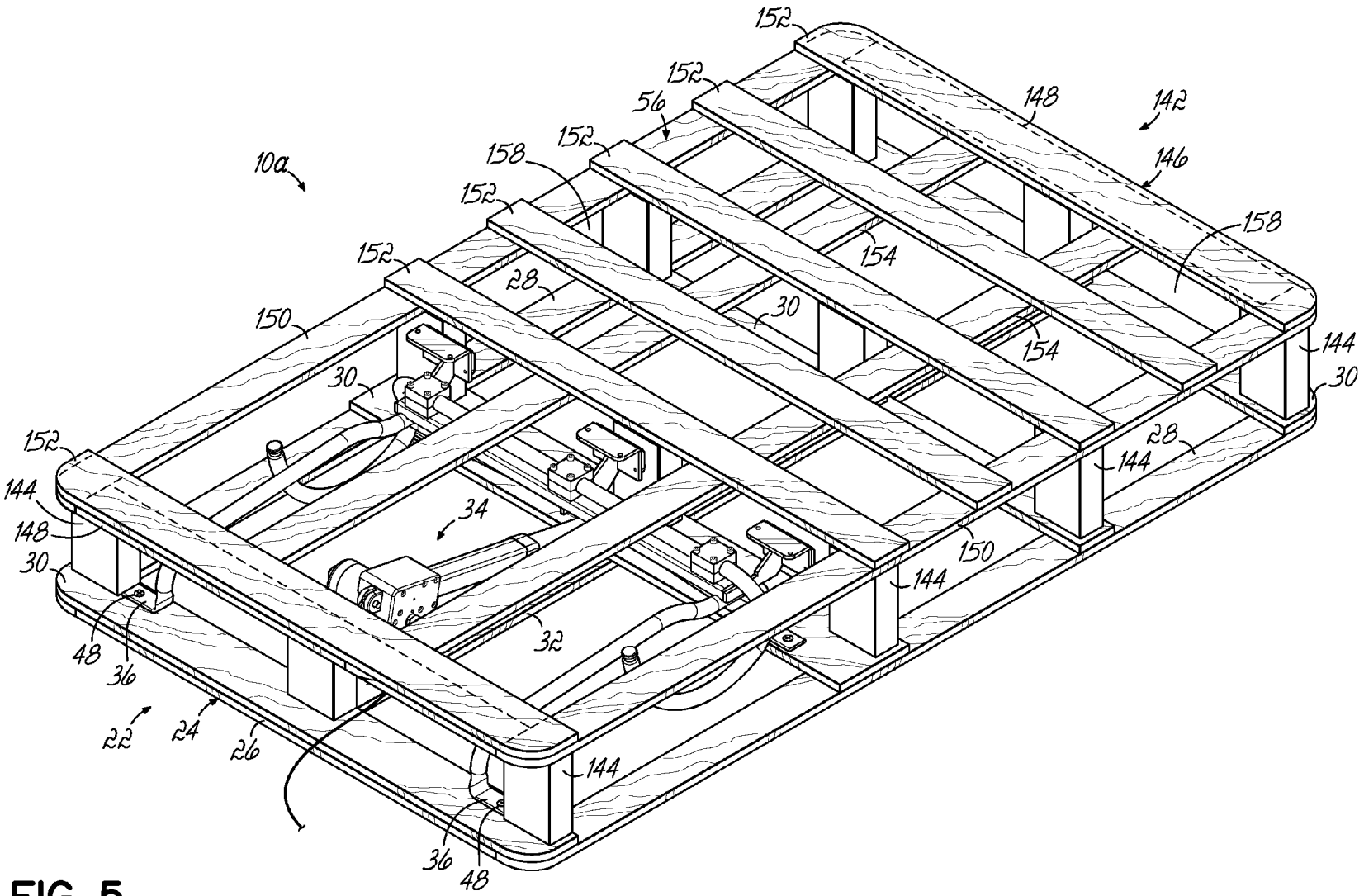
FIG. 5 is a perspective view of another embodiment of adjustable bedding foundation, shown without a covering and without a deck board.
Figure 6:
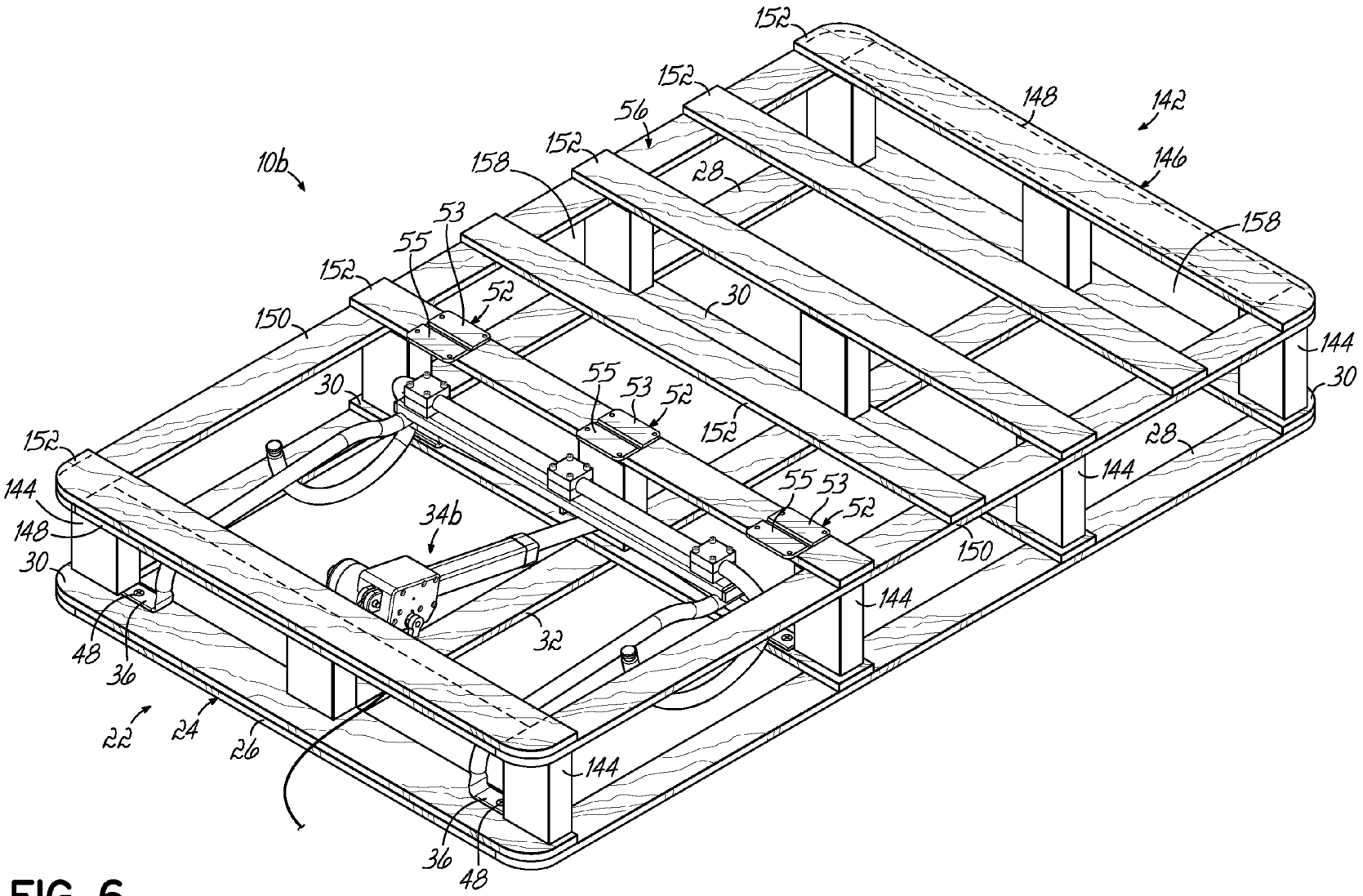
FIG. 6 is a perspective view of another embodiment of adjustable bedding foundation, shown without a covering and without a deck board.
Figure 7:
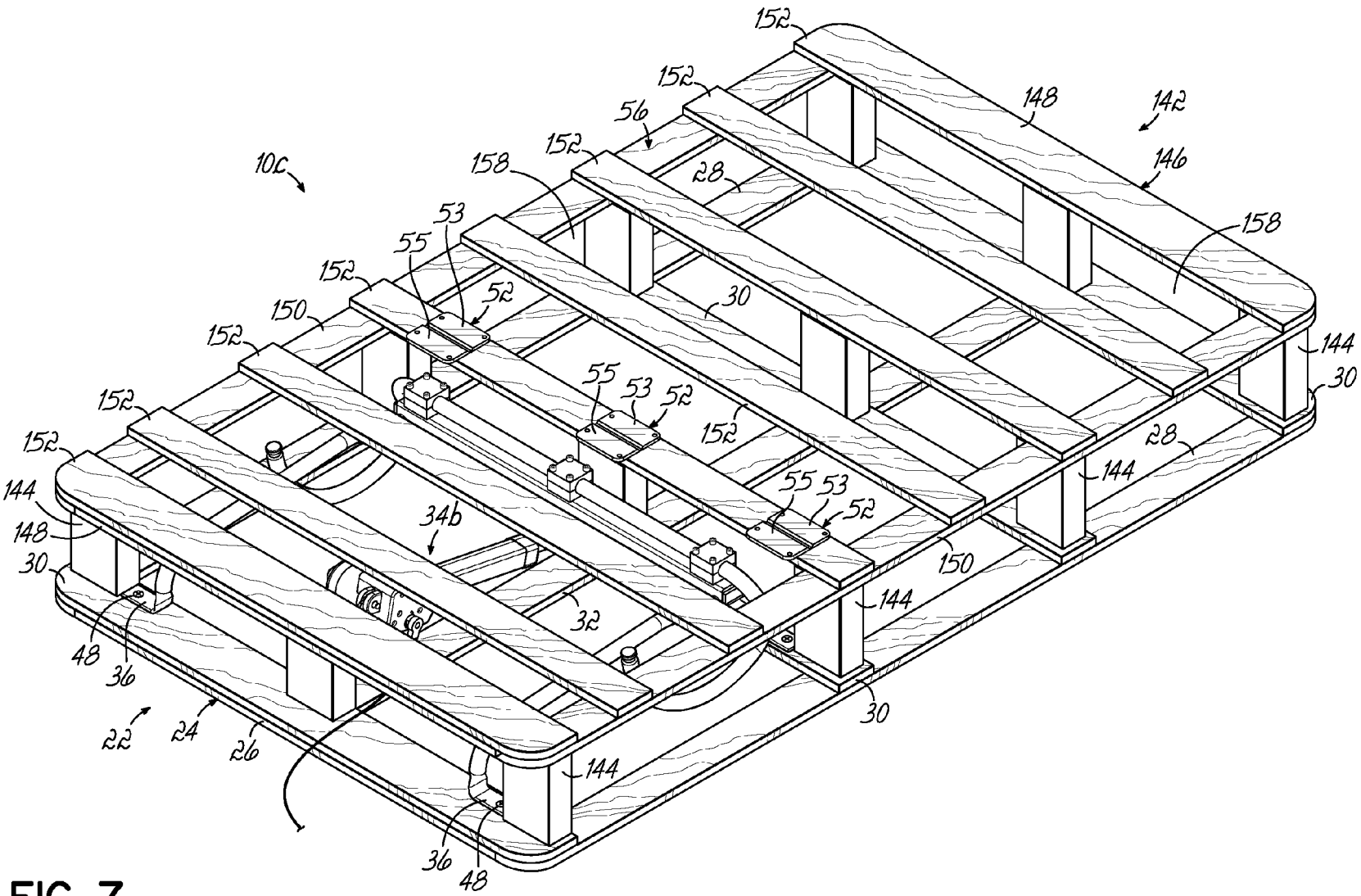
FIG. 7 is a perspective view of another embodiment of adjustable bedding foundation, shown without a covering and without a deck board.

FIGS. 5-7 illustrate alternative embodiments of adjustable bedding foundations in which no wire assemblies are used. For simplicity, like parts are designated with like numbers.

FIG. 5 illustrates an adjustable bedding foundation 10*a* comprising a base 22 and a motorized lift assembly 34.

Adjustable bedding foundation 10*a* further comprises an upper grid or lattice 142 of intersecting members spaced above the base 22 with spacers 144. More particularly, the upper grid 142 comprises a generally rectangular upper frame 146 comprising end members 148 and side members 150. In addition, the upper grid 142 comprises a plurality of upper slats 152 extending between side members 150 of the upper frame 146 and a plurality of upper supports 154 extending between end members 148 of the upper frame 146 (only two being shown). Although the drawings show a specific number of intersecting members of the upper grid or lattice 142, any number of upper supports 154 and/or upper slats 152 (support members) may be used. If desired, the upper supports 154 may be omitted. The intersecting members 152, 154 of the upper grid 142 define a plurality of openings 158. The openings 158 of the upper grid or lattice 142 may be different sizes and shapes; they need not be the same size or shape. The base 22, spacers 144 and members of the upper grid 142 may be made of wood, plastic or other material. Together, the base 22, spacers 144 and upper grid 142 forms a support assembly 156, the motorized lift assembly 34 being secured to the base 22.

FIG. 6 illustrates an adjustable bedding foundation 10*b* comprising a base 22 and a motorized lift assembly 34*b*. The motorized lift assembly 34*b* may be identical to motorized lift assembly 34, but may lack hinge mounts 50. Adjustable bedding foundation 10*b* further comprises an upper grid 142 of wooden members spaced above the base 22*a* with spacers 144. More particularly, the upper grid 142 comprises a generally rectangular upper frame 146 comprising end members 148 and side members 150. In addition, the upper grid 142 comprises a plurality of upper slats 152 extending between side members 150 of the upper frame 146. Hinges 52, rather than being mounted to the motorized lift assembly, are instead secured to one of the upper slats 152. If desired, the embodiments of FIG. 6 may include two or more upper supports (not shown) extending between end members 148 of the upper frame 146. Together, the base 22, spacers 144 and upper grid 142 form a support assembly 156, the motorized lift assembly 34*b* being secured to the base 22.

FIG. 7 illustrates an adjustable bedding foundation 10*c* identical to the adjustable bedding foundation 10*b*, but with two additional upper slats 152 added. If desired, the embodiment of FIG. 7 may include two or more upper supports (not shown) extending between end members 148 of the upper frame 146. Together, the base 22, spacers 144 and upper grid 142 form a support assembly 156, the motorized lift assembly 34*b* being secured to the base 22.

Figure 8A:
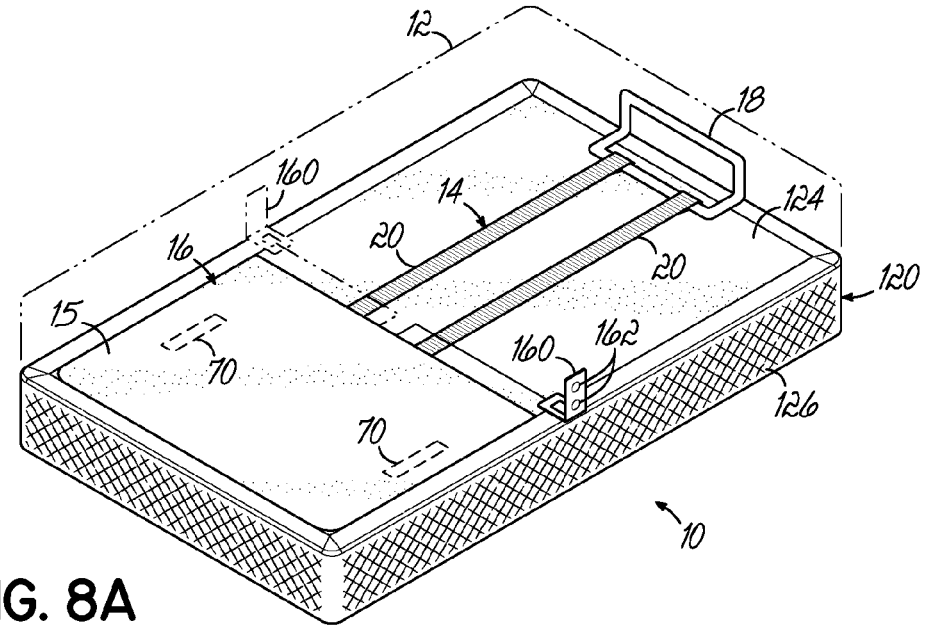
FIG. 8A is a perspective view of another embodiment of adjustable bedding foundation.
Figure 8B:
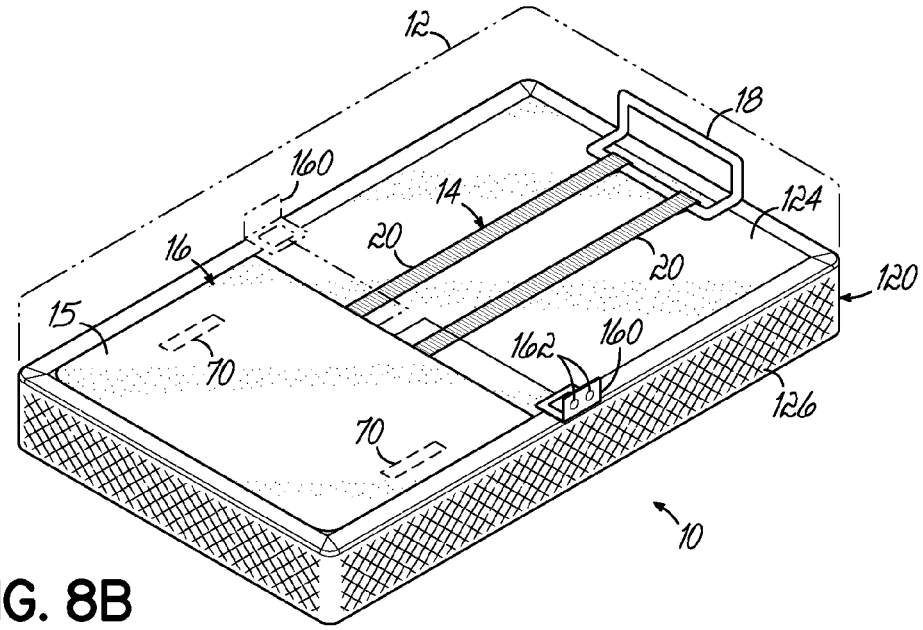
FIG. 8B is a perspective view of another embodiment of adjustable bedding foundation.

FIGS. 8A and 8B illustrate another aspect of adjustable bedding foundation 10. The motorized lift assembly 34 of adjustable bedding foundation 10 may be powered by two remote controls 160 on opposite sides of the bed. Each remote control 160 may be sandwiched between the mattress 12 and adjustable foundation 10. Each remote control 160 comprises an "L-shaped" plastic bracket which has two input buttons or sensors 162 mounted one above the other, as shown in FIG. 8A, or side-by-side, as shown in FIG. 8B. This technology is known in the industry as "Cap Touch" or Capacitive Touch because it uses capacitive sensing technology to detect a button press, rather than using an actual button. It consists of a very shallow metal disk attached to a wire that connects to a sensor. The sensor detects human contact and activates the motor. Controllers having such sensors may be purchased by OKIN Refined Electric Technology Company, Limited or Limoss U.S., L.L.C. of Baldwyn, Miss. and sold under Part No. 500446. Each remote control 160 is not fixed in a predetermined position; it may be moved to a desired located based on a user's preference.

Figure 9:
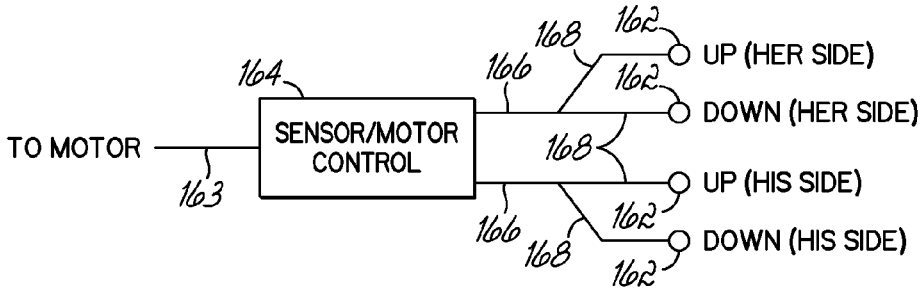
FIG. 9 is a diagrammatic view of the wiring of the embodiment of adjustable bedding foundation shown in FIGS. 9A and 9B.

As shown in FIG. 9, the wire 163 coming from the control box 80 of motorized lift assembly 34 of adjustable bedding foundation 10 extends to a motor control or controller 164. Two wires 166 extend from the controller 164 to sensors 162 in one embodiment. However, as shown in FIG. 9, each wire 166 may be split into two wires 168, each terminating in a sensor 162.

While the invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. An adjustable bedding foundation comprising:

a base;

a lattice of support elements spaced above the base;

a motorized lift assembly comprising a stationary frame secured to the base and a motorized actuator pivotally coupled to the frame, the motorized actuator including a piston movable inside a cylinder, the motorized lift assembly further comprising a movable lifter secured to one end of the piston, the movable lifter including multiple spaced tusks;

stationary hinge mounts fixedly secured to the stationary frame of the motorized lift assembly;

a hinge secured to each of the stationary hinge mounts;

a head board secured to the hinges;

wherein activation of the lift assembly moves the tusks of the lift assembly through at least one opening in the lattice of support elements to contact and adjust the position of the head board.

2. The foundation of claim 1 wherein the tusks of the motorized lift assembly are not attached to the head board.

3. The foundation of claim 1 wherein the lattice of support elements includes some wire elements.

4. The foundation of claim 1 wherein the base comprises a generally rectangular frame having two opposed sides and two opposed ends, the base further comprising a plurality of slats extending between the frame sides.

5. The foundation of claim 4, wherein the stationary frame of the motorized lift assembly is secured to at least one of the slats of the base.

6. An adjustable bedding foundation comprising:

a base and a wire assembly secured to the base;

a motorized lift assembly comprising a stationary rectangular frame secured to the base and a motorized actuator pivotally coupled to a mounting member secured to the frame, the motorized actuator including a piston movable inside a cylinder, the motorized lift assembly further comprising a movable lifter pivotally secured to one end of the piston, the movable lifter including multiple spaced tusks;

at least one stationary hinge mount fixedly secured to the stationary frame of the motorized lift assembly;

a hinge secured to each stationary hinge mount;

a head board secured to each hinge;

wherein activation of the lift assembly moves the tusks of the lift assembly through at least one opening in the wire assembly to adjust the position of the head board.

7. The foundation of claim 6 wherein the motorized lift assembly has multiple stationary hinge mounts and multiple hinges.

8. The foundation of claim 6 wherein the motorized lift assembly has at least two stationary hinge mounts and at least two hinges.

9. The foundation of claim 6 wherein two of the members of the stationary rectangular frame secured to the base are arched.

10. The foundation of claim 6 further comprising contact members secured to a free end of each tusk and slider strips attached to an underside of the deck board and positioned to abut the contact members.

11. The foundation of claim 6, further comprising mounting members secured to the stationary frame of the motorized lift assembly, a portion of the movable lifter passing through the mounting members.

12. The foundation of claim 6, wherein the wire assembly comprises a wire grid comprising a generally rectangular border wire having two parallel sides and two parallel ends and a plurality of spaced and longitudinally extending support wires extending between the border wire ends, each support wire having a plurality of flattened peaks co-planar with the upper grid and a plurality of flattened valleys secured to the base.

13. The foundation of claim 12, wherein the wire grid further comprises a longitudinally spaced, parallel and transversely extending upper connector wire parallel to the border wire ends and having ends connected to the border wire sides, the upper connector wires being connected intermediate of their ends along their lengths thereof to the flattened peaks of the support wires.

14. The foundation of claim 6, wherein the movable lifter comprises a lift arm having a straight portion extending between the tusks, the straight portion of the lift arm passing through multiple stationary mounting members secured to the frame of the motorized lift assembly.

15. The foundation of claim 14, wherein the tusks of the movable lifter move relative to the head board during movement of the head board.

16. The foundation of claim 6, wherein the base comprises a generally rectangular frame having two opposed sides and two opposed ends and a plurality of slats extending between the frame sides and the stationary frame of the motorized lift assembly is secured to at least one of the slats of the base.

17. An adjustable bedding foundation comprising:

a base comprising a generally rectangular frame having two opposed sides and two opposed ends and a plurality of slats extending between the frame sides;

an upper grid spaced above the base with spacers;

a motorized lift assembly comprising a stationary rectangular frame secured to at least one of the slats of the base, wherein two members of the stationary rectangular frame secured to the base are arched, and a motorized actuator pivotally coupled to at least one mounting member secured to the stationary frame, the motorized actuator comprising a movable piston, one end of the piston being secured to a movable lifter, the movable lifter including a straight portion extending through the at least one mounting member and multiple spaced tusks at opposite ends of the straight portion;

hinges secured to the upper grid;

a head board secured to the hinges;

wherein activation of the lift assembly moves the tusks of the lift assembly through at least one opening in the upper grid to contact and adjust the position of the head board.

18. The foundation of claim 17 wherein the upper grid includes wooden slats.

19. The foundation of claim 17, wherein the base is made of wood and the stationary frame of the motorized lift assembly is made of metal.

20. The foundation of claim 19, wherein the upper grid and spacers are made of wood.

21. An adjustable bedding foundation comprising:

a base;

a wire assembly secured to the base;

a motorized lift assembly comprising a stationary frame secured to the base and a motorized actuator pivotally coupled to at least one mounting member secured to the stationary frame, the motorized actuator comprising a movable piston, one end of the piston being secured to a movable lifter, the movable lifter including a straight portion extending through the at least one mounting member and multiple spaced tusks at opposite ends of the straight portion;

stationary hinge mounts fixedly secured to the stationary frame of the motorized lift assembly;

a hinge secured to each of the stationary hinge mounts;

a head board secured to the hinges;

wherein activation of the lift assembly moves the tusks of the lift assembly through at least one opening in the wire assembly to contact and adjust the position of the head board.

22. The foundation of claim 21 wherein the base comprises a generally rectangular frame having two opposed sides and two opposed ends and a plurality of slats extending between the frame sides and the stationary frame of the motorized lift assembly is secured to at least one of the slats of the base.

23. The foundation of claim 21, wherein the wire assembly comprises a wire grid comprising a generally rectangular border wire having two parallel sides and two parallel ends and a plurality of spaced and longitudinally extending support wires extending between the border wire ends, each support wire having a plurality of flattened peaks co-planar with the upper grid and a plurality of flattened valleys secured to the base.

24. The foundation of claim 21, wherein the wire grid further comprises a longitudinally spaced, parallel and transversely extending upper connector wire parallel to the border wire ends and having ends connected to the border wire sides, the upper connector wires being connected intermediate of their ends along their lengths thereof to the flattened peaks of the support wires.

25. The foundation of claim 21 further comprising contact members secured to a free end of each tusk and slider strips attached to an underside of the deck board and positioned to abut the contact members.

26. The foundation of claim 21, wherein the tusks of the movable lifter move relative to the head board during movement of the head board.

27. The foundation of claim 21 further comprising a mattress stopping bracket.

28. An adjustable bedding foundation comprising:

a base;

a wire grid spaced above the base;

a motorized lift assembly comprising a stationary frame secured to the base and a motorized actuator comprising a movable piston, one end of the piston being secured to a movable lifter, the movable lifter including a straight portion and a tusk at opposite ends of the straight portion, the straight portion extending through multiple stationary mounting members, the stationary mounting members being secured to the stationary frame;

stationary hinge mounts fixedly secured to the stationary frame of the motorized lift assembly;

a hinge secured to each of the stationary hinge mounts;

a head board secured to the hinges;

wherein activation of the lift assembly moves the tusks of the lift assembly through at least one opening in the wire grid to adjust the position of the head board.

29. The foundation of claim 28, wherein the tusks of the movable lifter move relative to the head board during movement of the head board.

* * * * *